US007894734B2

(12) United States Patent
Sawamura et al.

(10) Patent No.: US 7,894,734 B2
(45) Date of Patent: Feb. 22, 2011

(54) PRESSURE ADJUSTING MECHANISM FOR A FIXING DEVICE AND IMAGE FORMING APPARATUS

(75) Inventors: Jun Sawamura, Saitama (JP); Masaharu Inaba, Saitama (JP); Hideki Sato, Saitama (JP); Yasuo Suzuki, Saitama (JP); Hitoshi Nanba, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 801 days.

(21) Appl. No.: 11/352,214

(22) Filed: Feb. 13, 2006

(65) Prior Publication Data

US 2007/0019977 A1 Jan. 25, 2007

(30) Foreign Application Priority Data

Jul. 21, 2005 (JP) ..... 2005-211468

(51) Int. Cl.
*G03G 15/20* (2006.01)

(52) U.S. Cl. ..... 399/67; 399/332

(58) Field of Classification Search ..... 399/67, 399/122, 328, 332, 331, 339
See application file for complete search history.

(56) References Cited

U.S. PATENT DOCUMENTS

| | | | | |
|---|---|---|---|---|
| 4,110,068 | A * | 8/1978 | Brown et al. | |
| 5,140,378 | A * | 8/1992 | Ibuchi et al. | |
| 5,572,307 | A * | 11/1996 | Tomatsu et al. | 399/122 |
| 5,946,975 | A | 9/1999 | Yun | |
| 6,253,046 | B1 * | 6/2001 | Horrall et al. | 399/124 |
| 6,411,785 | B1 | 6/2002 | Ogawahara et al. | |
| 2002/0127037 | A1 * | 9/2002 | Fujii | 399/371 |
| 2003/0180075 | A1 * | 9/2003 | Hayami et al. | 399/328 |

FOREIGN PATENT DOCUMENTS

| | | | |
|---|---|---|---|
| JP | 60-65762 | U | 5/1985 |
| JP | 2-266384 | A | 10/1990 |
| JP | 3-107182 | A | 5/1991 |
| JP | 4-166969 | A | 6/1992 |
| JP | 5-116691 | A | 5/1993 |
| JP | 5-119555 | A | 5/1993 |
| JP | 6-110353 | A | 4/1994 |
| JP | 7-325501 | A | 12/1995 |
| JP | 8-69202 | | 3/1996 |
| JP | 9-179435 | A | 7/1997 |

(Continued)

OTHER PUBLICATIONS

Fuser Drive Mechanism, Oct. 1976, IBM Technical Disclosure Bulletin, vol. 19, Is.5, pp. 1597-1598.*

*Primary Examiner*—David M Gray
*Assistant Examiner*—Laura K Roth
(74) *Attorney, Agent, or Firm*—Sughrue Mion, PLLC

(57) ABSTRACT

A fixing device includes a heating member disposed with an internal heating source and a pressuring member that presses against the heating member. The fixing device is configured to be attachable to and detachable from an image forming apparatus body, and includes: brackets that retain the heating member; pressuring levers that retain the pressuring member and are movably supported in the brackets; urging means that push the pressuring levers in a direction where the pressuring member presses against the heating member; and cams that are rotatably supported in the brackets, contact the pressuring levers, and adjust the pressuring force of the pressuring member.

20 Claims, 14 Drawing Sheets

FOREIGN PATENT DOCUMENTS

| | | | |
|---|---|---|---|
| JP | 10-282828 | A | 10/1998 |
| JP | 11-344895 | A | 12/1999 |
| JP | 2000-221828 | A | 8/2000 |
| JP | 2000-338815 | A | 12/2000 |
| JP | 2001-154529 | A | 6/2001 |
| JP | 2001-249569 | | 9/2001 |
| JP | 2003-241562 | A | 8/2003 |
| JP | 2004-109521 | | 4/2004 |
| KR | 10-2005-0038079 | A | 4/2005 |

* cited by examiner

PRESSURE ADJUSTING MECHANISM FOR A FIXING DEVICE AND IMAGE FORMING APPARATUS

CROSS-REFERENCE TO RELATED APPLICATION

This application claims priority under 35 USC 119 from Japanese Patent Application No. 2005-211468, the disclosure of which is incorporated by reference herein.

BACKGROUND OF THE INVENTION

1. Field of the Invention

The present invention relates to a fixing device that fixes a toner image on a recording medium between a heating member and a pressuring member, and to an image forming apparatus, such as a copier or a laser printer, disposed with this fixing device.

2. Description of the Related Art

In image forming apparatus such as copiers and printers, an image carrier such as a photoconductor is charged and irradiated with laser light such that an electrostatic latent image is formed on the surface of the image carrier. The electrostatic latent image is made visible by a developing device, and a toner image comprising powder toner is formed. Then, the toner image is transferred to a recording medium such as paper, and thereafter the toner image on the recording medium is fixed onto the recording medium by a fixing device, whereby an image is formed.

The fixing device includes a heating roller, which comprises a rotor disposed with an internal heater, and a pressuring roller, which presses the recording medium against the heating roller. The recording medium on which the toner image has been formed is passed between the heating roller and the pressuring roller, and the toner image is fused and fixed onto the recording medium as a result of being heated and pressured. Sometimes, in consideration of maintenance and the like, the fixing device is configured as a unit that is attachable to and detachable from the image forming apparatus.

In such a fixing device, a recording medium such as an envelope sometimes becomes wrinkled when a heavy load is applied thereto when the toner image on the recording medium is fixed at the portion where the heating roller and the pressuring roller press the recording medium. For this reason, fixing devices have conventionally been proposed where the load of the pressuring roller can be varied manually. However, when the load of the pressuring roller is manually varied by the user, the recording medium cannot be completely prevented from becoming wrinkled, and the recording medium can end up becoming wrinkled due to mistakes or the like.

In Japanese Patent Application Publications (JP-A) Nos. 8-69202 and 2001-249569, fixing devices have been proposed which are configured to automatically adjust the load of the pressuring roller pressing against the heating roller by causing a swinging arm that presses a support shaft of the pressuring roller to swing. However, these fixing devices have many parts and expensive configurations because they include various kinds of parts such as a one-way clutch, a motor and a cam floor.

In Japanese Patent Application Publication No. 2004-109521, a fixing device has also proposed where the number of parts is reduced by disposing a reference position changing cam. With this configuration, the cost can be reduced, but the ease with which the unit can be loaded into and unloaded from the image forming apparatus and the stability in the precision of the unit and cam position are not taken into consideration.

That is, among conventional fixing devices, there have been none that can satisfy the stability in the precision of the unit and cam position while maintaining the ease with which the unit can be loaded into and unloaded from the image forming apparatus body.

SUMMARY OF THE INVENTION

The present invention has been made in view of these circumstances and provides a fixing device and an image forming apparatus that can suppress the occurrence of wrinkles in the recording medium by automatically varying the load of the pressuring roller on the heating roller, and which have excellent stability in precision as a unit.

A first aspect of the invention provides a fixing device for an image forming apparatus, the device including: a heating member disposed with an internal heating source and a pressuring member that presses against the heating member; brackets that retain the heating member; pressuring levers that retain the pressuring member and are movably supported in the brackets; urging means that push the pressuring levers in a direction where the pressuring member presses against the heating member; and tension adjusting means that are rotatably supported in the brackets, contact the pressuring levers, and adjust the pressuring force of the pressuring member, wherein the fixing device is attachable to and detachable from the image forming apparatus body.

According to the first aspect, the pressuring levers support the pressuring member and are movably supported in the brackets retaining the heating member. The pressuring levers are pushed by the urging means, and the pressuring member presses against the heating member. When the tension adjusting means rotatably supported in the brackets are rotated, the tension adjusting means contact the pressuring levers and the pressuring force of the pressuring member is adjusted. Thus, the load of the pressuring member on the heating member can be appropriately adjusted, and the occurrence of wrinkles in the recording medium can be suppressed.

Further, because the drive source that causes the tension adjusting means to rotate is disposed in the image forming apparatus side to which the fixing device is attached, the power source can be configured to be in the "enclosed" state among the brackets, the pressuring levers, the urging means and the tension adjusting means, which is advantageous in terms of preventing deformation and ensuring precision stability of the constituent parts. The assembly is also easy in this structure.

In a second aspect of the invention, the fixing device includes a first mode where the tension adjusting means do not contact the pressuring levers and a second mode where the tension adjusting means contact the pressuring levers and the pressuring levers move to a predetermined pressuring position.

According to the second aspect, it is possible to switch between the first mode and the second mode depending on the type of recording medium. For example, in the first mode (for plain paper or the like), the tension adjusting means do not contact the pressuring levers and the pressuring member has a fixed load. In the second mode (for envelopes or the like), the pressuring levers can be fixedly displaced (interaxially fixed) to move to a predetermined pressuring position. Thus, the stroke of the pressuring levers can be reduced, which is advantageous in terms of the design of the tension adjusting means.

In a third aspect of the invention, the pressuring levers and the tension adjusting means are disposed at both end portions of the pressuring member based on the first or second aspect, the fixing device further includes a shaft that transmits the rotation of one of the tension adjusting means to the other of the tension adjusting means and a reading plate that is disposed on an end portion of the shaft and is for reading the rotational position of the tension adjusting means, and the reading plate is disposed near the other of the tension adjusting means.

In the third aspect of the invention, the shaft becomes kinked because there is rotational resistance in the tension adjusting means (the other tension adjusting means) opposite from the tension adjusting means (the one tension adjusting means) disposed near the drive. The reading precision can be raised by reading, with the reading plate, the rotational position of the tension adjusting means at the kinked side (the other tension adjusting means).

In a fourth aspect of the invention, the reading plate of the third aspect is attached to the other of the tension adjusting means.

According to the fourth aspect, because the reading plate is attached to the tension adjusting means opposite from the tension adjusting means near the drive, the reading precision of the rotational direction of the tension adjusting means can be raised more than in a configuration where the reading plate is fitted together with the shaft or the like.

In a fifth aspect of the invention, a gear that transmits driving force to the shaft based on the fourth or fifth aspect is disposed, and a shaft bearing of the gear is disposed in the image forming apparatus body.

According to the fifth aspect, the gear can be firmly retained by the shaft bearing because the shaft bearing of the gear that transmits driving force to the shaft is disposed in the image forming apparatus. For this reason, the shaft and the fixing device themselves do not end up moving due to the driving of the gear, even if the torque of the tension adjusting means is large.

In a sixth aspect of the invention, the gear based on the fifth aspect is fixed to a D-cut surface of the shaft, and an end portion of the shaft penetrating the gear is supported in the shaft bearing.

According to the sixth aspect, the gear is directly fixed to the D-cut surface of the shaft, and the end portion of the shaft is guided by the shaft bearing. Thus, the positional precision can be improved.

In a seventh aspect of the invention, the gear based on the fifth or sixth aspect includes teeth that are high teeth.

According to the seventh aspect, the teeth of the gear are high teeth. Thus, when the fixing device unit is to be attached to the image forming apparatus body, it is difficult for the tooth tips of the gear and the gear of the image forming apparatus body to knock against each other, and the fixing device can be smoothly attached to the image forming apparatus body.

When the gear has usual teeth, the tooth tips of the gear and the gear of the image forming apparatus body knock against each other, and the fixing device cannot be smoothly attached. This problem can be solved by tapering the tooth tips of the gear, which can be accomplished in two ways: with high teeth or with a displacement gear. In the case of a displacement gear, the drive tangent becomes oblique, the fixing device easily moves, and there is skipping. If the teeth of the gear are high teeth, the drive tangent becomes perpendicular and there is no skipping.

In an eighth aspect of the invention, a snap-fit portion disposed in the gear based on any of the fifth to seventh aspects is snap-fitted into a groove formed in the shaft.

According to the eighth aspect, the gear is fixed by being snap-fitted into the groove in the shaft. Thus, it is not necessary to screw the gear onto the shaft, and the assembly becomes easy.

In a ninth aspect of the invention, a sensor that detects a slit in the reading plate based on any of the third to eighth aspects is disposed in the image forming apparatus body.

According to the ninth aspect, because it becomes difficult for the fixing device to move, when the fixing device has been attached to the image forming apparatus body, precise detection becomes possible even when the sensor is disposed in the image forming apparatus body. The cost can also be reduced by disposing the sensor is disposed in the image forming apparatus body.

In a tenth aspect of the invention, the shaft bearing based on the fifth or sixth aspect doubles as a member that fixes and/or positions the fixing device with respect to the image forming apparatus body.

According to the tenth aspect, the shaft bearing fixes and/or positions the unit. And because the shaft bearing has a configuration where the positional precision of the reading plate is high, the sensor of the reading plate can be disposed in the image forming apparatus body. For this reason, a reduction in cost is possible.

In an eleventh aspect of the invention, the rotational direction of the tension adjusting means based on any of the first to tenth aspects is a forward direction where the pressuring levers and the tension adjusting means are not associated.

When the rotational direction of the tension adjusting means is a direction associated with the movement of the pressuring levers, the movement of the pressuring levers becomes jerky no longer smooth. But according to the eleventh aspect of the invention, the movement of the pressuring levers can be made smooth because the rotational direction of the tension adjusting means is the forward direction that is not associated with the pressuring levers.

In a twelfth aspect of the invention, the gear that transmits driving force to the shaft is disposed opposite from a drive mechanism that drives the heating member or the pressuring member based on any of the fifth to eleventh aspects.

The drive mechanism that drives the heating member or the pressuring member and the drive mechanism of the tension adjusting means require space. However, according to the twelfth aspect of the invention, the drive mechanisms are disposed at opposite sides, which is advantageous in terms of space.

In a thirteenth aspect of the invention, the fixing device based on any of the first to twelfth aspects further comprises a motor that drives the tension adjusting means, is a DC motor, is slowed down by a worm gear and transmits driving force.

In this configuration, the required rotation of the tension adjusting means is an extremely low rotation and a high load. According to the thirteenth aspect of the invention, the combination of the DC motor and the worm gear is slowed down and transmits driving force, which is advantageous in terms of space, cost, and output.

In a fourteenth aspect of the invention, the motor based on the thirteenth aspect is a brush motor.

The time during which the tension adjusting means are caused to rotate is extremely limited. Thus, the inexpensive brush motor of the fourteenth aspect of the invention can be used, and the cost can be reduced.

In a fifteenth aspect of the invention the urging means based on the first or second aspect are configured by guide members disposed such that they extend from the brackets, open holes that are formed in the pressuring levers and through which the guide members are inserted, and compression springs through which the guide members are inserted, with the compression springs including one end that contacts edge portions of the open holes and another end that contacts flanges formed on end portions of the guide members.

According to the fifteenth aspect of the invention, the pressuring levers are pushed in the direction of the guide members of the brackets by disposing in the urging means the compression springs that include one end that contacts edge portions of the open holes and another end that contacts flanges formed on end portions of the guide members. The pressuring levers can also be easily moved to predetermined movement positions as a result of the compression springs being compressed by the rotation of the tension adjusting means.

In a sixteenth aspect of the invention, the urging means based on the first or second aspect are configured by first spring receivers formed in the brackets, second spring receivers that are formed in the pressuring levers and are positioned nearer to the tension adjusting means than the first spring receivers, and spring receiver-use compression springs that are disposed between the first spring receivers and the second spring receivers.

According to the sixteenth aspect, the spring receiver-use compression springs are disposed between the first spring receivers and the second spring receivers, whereby the pressuring levers can be pushed toward the brackets and the configuration can be simplified.

In a seventeenth aspect of the invention, bearings are disposed on contact surfaces of the tension adjusting means based on any of the first to sixteenth aspects where the tension adjusting means contact the pressuring levers.

According to the seventeenth aspect, the sliding resistance of the tension adjusting means becomes smaller as a result of disposing the bearings on the contact surfaces.

An eighteenth aspect of the invention provides a fixing device for an image forming apparatus, the device including: a heating member disposed with an internal heating source and a pressuring member that presses against the heating member; brackets that retain the heating member; pressuring levers that retain the pressuring member and are movably supported in the brackets; tension springs that include one end coupled to the pressuring levers and pull the pressuring levers in a direction where the pressuring member presses against the heating member; and cams that are rotatably supported in the brackets, support the other ends of the tension springs, and change the support positions of the tension springs, wherein the fixing device is attachable to and detachable from the image forming apparatus body.

In the eighteenth aspect of the invention, the cams include one end coupled to the pressuring levers and pull the pressuring levers in the direction where the pressuring member presses against the heating member. The tension adjustment means are rotatably supported in the brackets, support the other ends of the cams, and change the support positions of the cams. Thus, the pressuring force of the pressuring member can be adjusted, and the configuration can be further simplified.

In a nineteenth aspect, the tension adjusting means based on the eighteenth aspect are tension spring-use cams to which leading ends of the cams are attached.

According to the nineteenth aspect, the tension of the cams can be adjusted by causing the tension spring-use cams to rotate.

In a twentieth aspect of the invention, grooves corresponding to hooks formed on the other ends of the cams are disposed in the tension spring-use cams based on the nineteenth aspect.

According to the twentieth aspect, the hooks of the cams can be firmly retained in the cams by hooking the hooks into the grooves disposed in the tension spring-use cams.

In a twenty-first aspect of the invention, bearings are disposed on outer peripheries of the tension spring-use cams.

According to the twenty-first aspect, the sliding resistance of the cams, the springs and the hooks can be becomes smaller as a result of disposing the bearings on the outer peripheries of the tension spring-use cams.

In a twenty-second aspect of the invention, an image forming apparatus includes the fixing device based on any of the first to twenty-first aspects.

According to the twenty-second aspect, the image forming apparatus includes the fixing device based on any of the first to twenty-first aspects. Thus, the pressuring force of the pressuring member on the heating member can be appropriately adjusted, and the occurrence of wrinkles in the recording medium can be suppressed. The movement of the fixing device attached to the image forming apparatus can be suppressed, and the precision stability can be improved.

Further, another aspect of the present invention may provide a fixing device for an image forming apparatus, the device including: a heating member disposed with an internal heating source and a pressuring member that presses against the heating member; brackets that retain the heating member; pressuring levers that retain the pressuring member and are movably supported in the brackets; tension springs that push the pressuring levers in a direction where the pressuring member presses against the heating member; and tension adjusting means that are rotatably supported in the brackets, contact the pressuring levers, and adjust the pressuring force of the pressuring member, wherein the fixing device is attachable to and detachable from the image forming apparatus body.

As described above, according to the present invention, the pressuring force of the pressuring member pressing against the heating member can be adjusted, and the occurrence of wrinkles in the recording medium can be suppressed. The precision stability as a fixing device attachable to and detachable from the image forming apparatus body can also be improved. The occurrence of curls and nip tracks in the recording medium can also be suppressed by adjusting the pressuring force of the pressuring member.

BRIEF DESCRIPTION OF THE DRAWINGS

Embodiments of the present invention will be described below with reference to the accompanying drawings, wherein.

DETAILED DESCRIPTION OF THE INVENTION

Preferred embodiments of a fixing device and an image forming apparatus pertaining to the invention will be described below on the basis of the drawings.

First Embodiment

Figure 1:
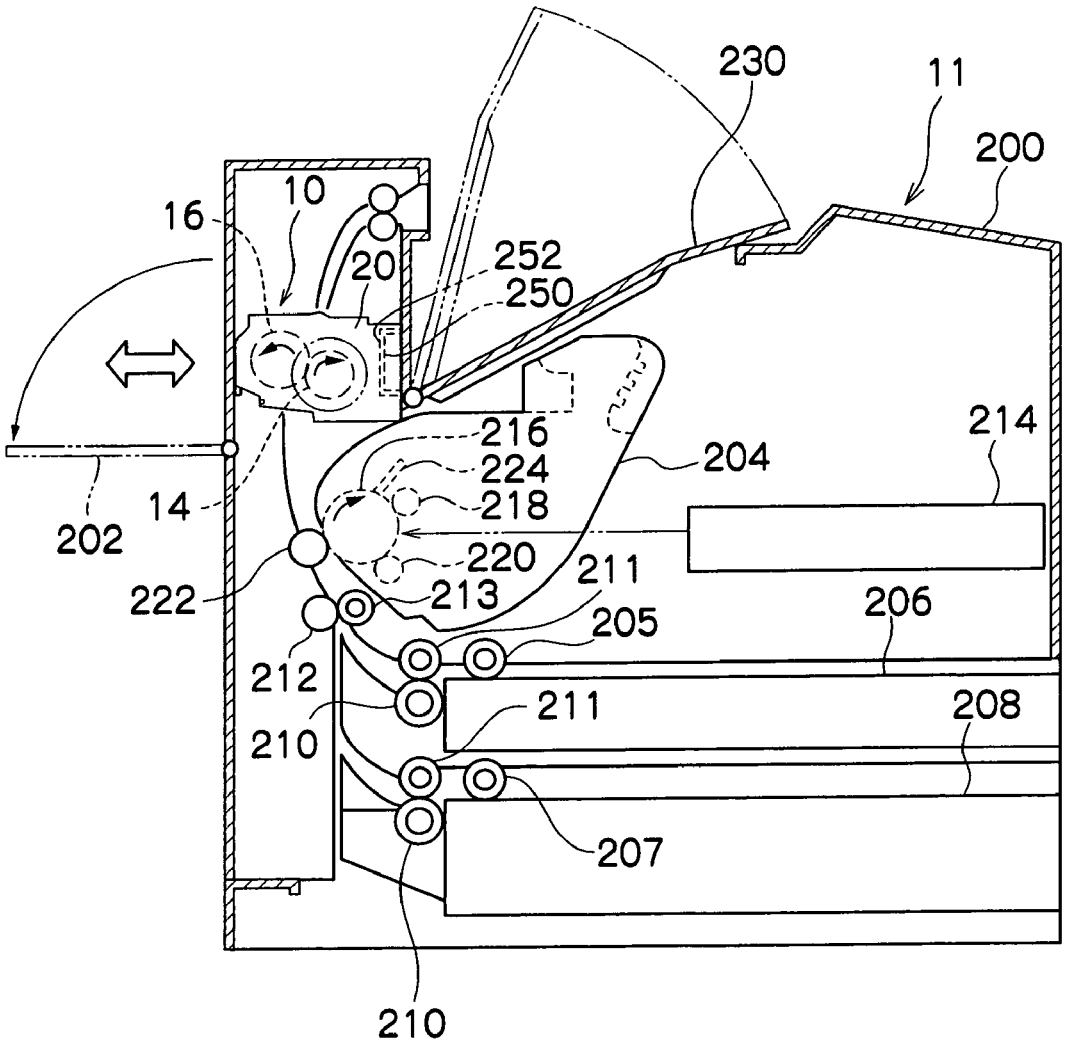
FIG. 1 is a schematic configural diagram showing an image forming apparatus disposed with a fixing device pertaining to a first embodiment of the invention.

FIG. 1 shows an image forming apparatus 11 to which a fixing device 10 pertaining to a first embodiment of the invention has been applied.

The image forming apparatus 11 includes an image forming apparatus body 200. The fixing device 10 comprises a unit that is attachable to and detachable from the image forming apparatus body 200. An open/close cover 202 is disposed on the image forming apparatus body 200, and the fixing device 10 is loaded into the image forming apparatus body 200 as a result of the open/close cover 202 being opened.

When the fixing device 10 is loaded into the image forming apparatus body 200, a connector 252 of the fixing device 10 becomes connected to a connector 250 of the image forming apparatus body 200, such that power can be supplied to the fixing device 10 and the completion of the loading of the fixing device 10 is detected. After the fixing device 10 has been loaded into the image forming apparatus body 200, the image forming apparatus 11 becomes operable as a result of the open/close door 202 being closed.

A process cartridge 204, in which an image forming section is integrally unitized, is disposed in the image forming apparatus body 200. A photoconductor drum 216 that rotates in one direction is disposed inside the process cartridge 204. Disposed around the periphery of the photoconductor drum 216 are a charge roller 218 that charges the photoconductor drum 216, a developing roller 220 that develops an electrostatic latent image formed on the photoconductor drum 216, and a transfer roller 222 that transfers onto paper the developed toner image on the photoconductor drum 216. A cleaning member 224 that cleans the surface of the photoconductor drum 216 after the toner image has been transferred from the photoconductor drum 216 to the paper is disposed downstream of the transfer roller 222 in the rotational direction of the photoconductor drum 216.

An exposure device 214 that irradiates the photoconductor drum 216 with image light is disposed between the charge roller 218 and the developing roller 220 in the image forming apparatus body 200.

Paper supply cassettes 206 and 208 that accommodate paper are disposed in the lower portion of the image forming apparatus body 200 such that they can be pulled out. Paper supply rollers 205 and 207 that remove and convey the paper one sheet at a time from the paper supply cassettes 206 and 208 are disposed at positions where they remove the paper in the paper supply cassettes 206 and 208. Conveyance rollers 210, 211, 212 and 213 that convey the paper supplied from the paper supply rollers 205 and 207 to the position where the photoconductor drum 216 and the transfer roller 222 face each other are also disposed.

The fixing device 10 is loaded into the image forming apparatus body 200 downstream of the transfer roller 222 in the conveyance direction of the paper. A paper discharge tray 230, into which the paper is discharged after the toner image has been fixed thereto, is disposed downstream of the fixing device 10. The fixing device 10 causes the toner image on the paper to be fixed to the paper between a heating roller 14 and a pressuring roller 16. The fixing device 10 will be described in greater detail later.

In the image forming apparatus 11, the photoconductor drum 216 is charged by the charge roller 216, and an electrostatic latent image is formed on the surface of the photoconductor drum 216 as a result of the surface of the photoconductor drum 216 being irradiated with image light from the exposure device 214. The electrostatic latent image is developed by the developing roller 220, and a toner image is formed on the photoconductor drum 216.

The paper is supplied by the paper supply roller 205 from the paper supply cassette 206 and conveyed by the conveyance rollers 210, 211, 212 and 213 to the position where the photoconductor drum 216 and the transfer roller 222 face each other. Then, the toner image on the photoconductor drum 216 is transferred onto the paper by the transfer roller 222, and the toner image is heated and pressured by the heating roller 14 and the pressuring roller 16 of the fixing device 10, whereby the toner image is fused and an image is fixed onto the paper. Thereafter, the paper on which the image has been formed is discharged into the paper discharge tray 230.

Next, the fixing device 10 will be described.

Figure 2:
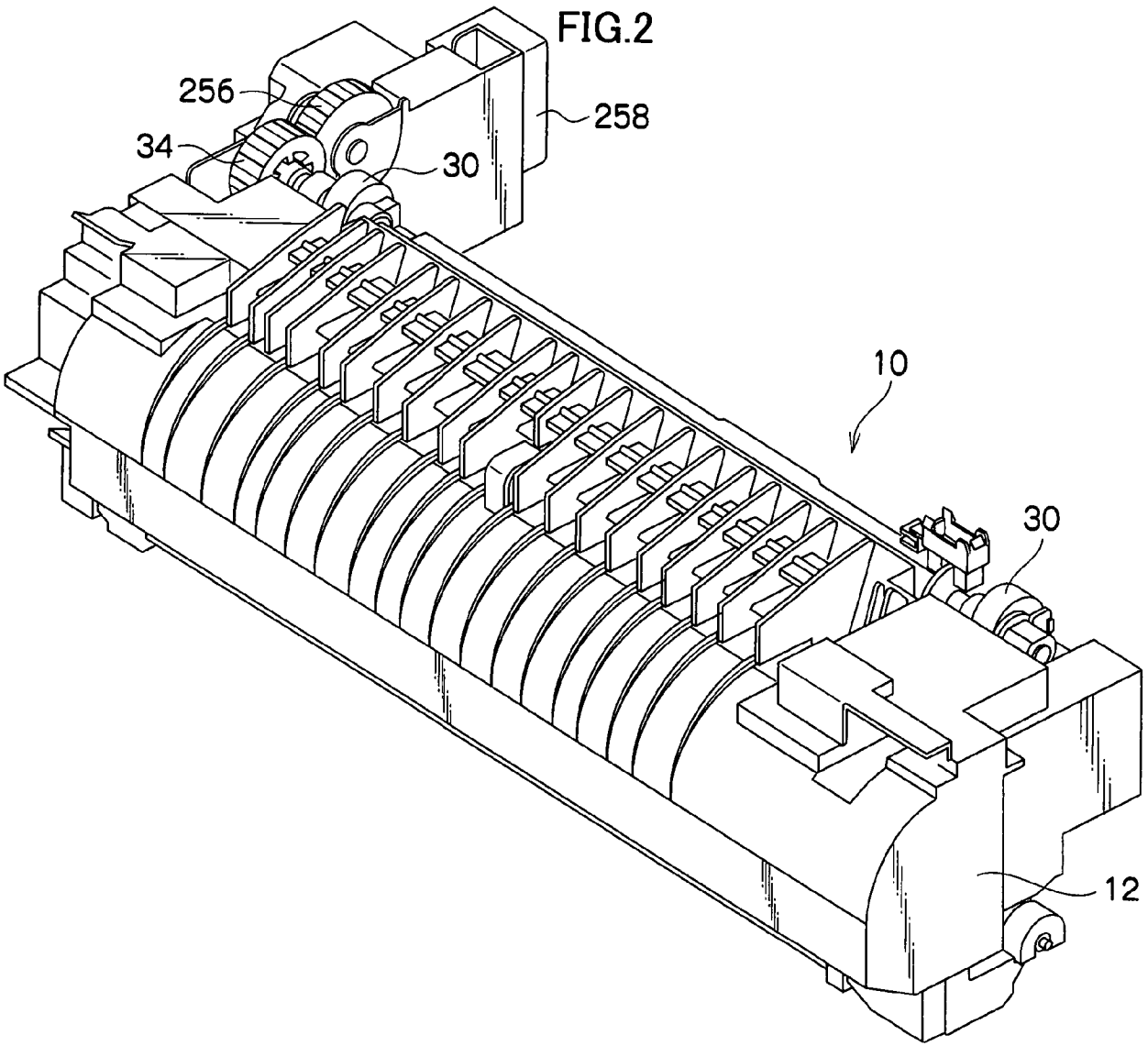
FIG. 2 is a perspective view showing the fixing device pertaining to the first embodiment of the invention.
Figure 4:
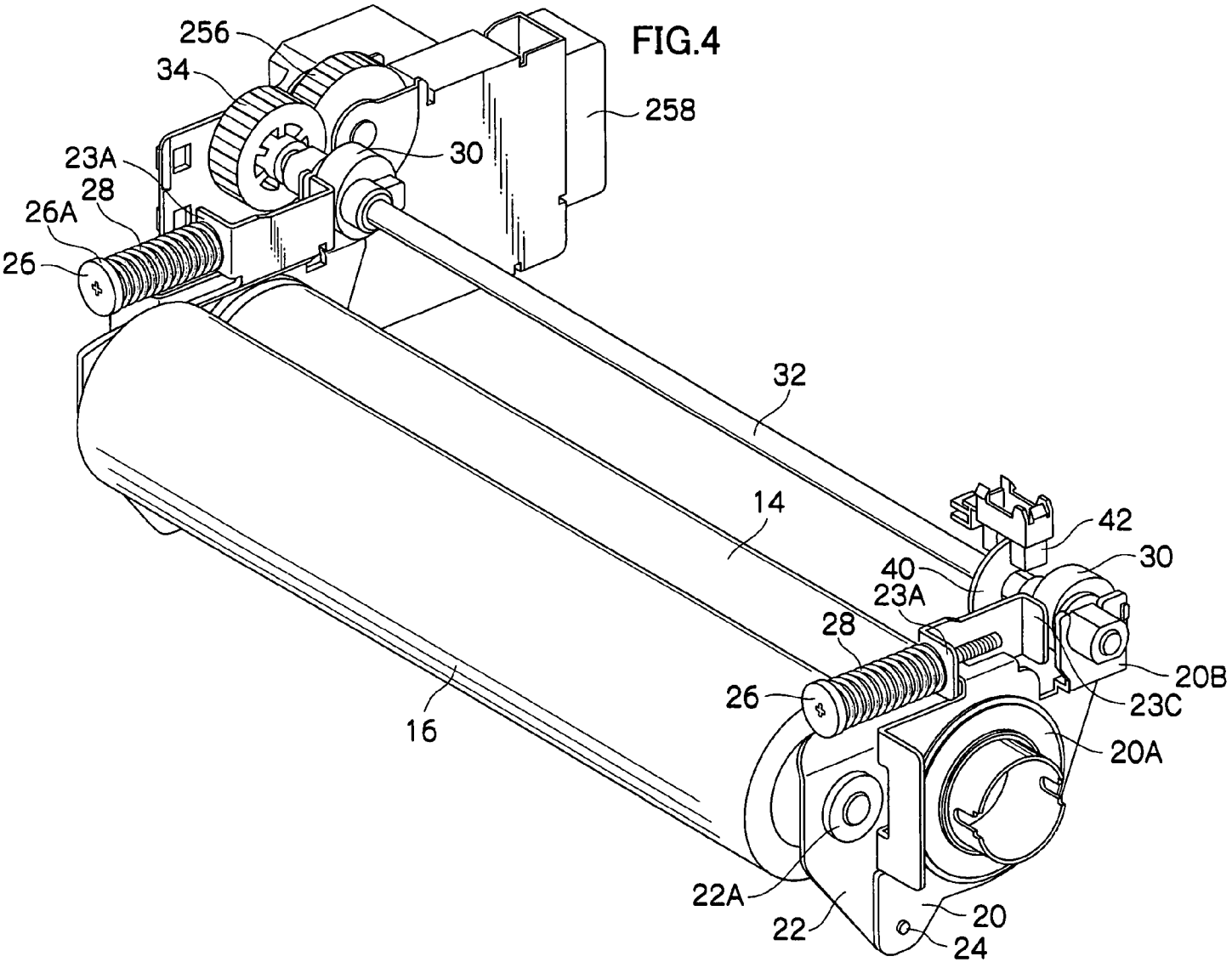
FIG. 4 is a perspective view showing an attachment structure of pressuring levers that retain a pressuring roller, brackets that retain a heating roller, and the cams of the fixing device shown in FIG. 2.

As shown in FIG. 2 and FIG. 4, the fixing device 10 includes a housing 12 disposed with the heating roller 14, which is heated to a predetermined fixing temperature, and the pressuring roller 16, which presses the paper against the heating roller 14. The heating roller 14 comprises a hollow cylindrical member (e.g., a steel tube) including a surface disposed with a low coefficient-of-friction release layer (not shown), and a heater is disposed inside the cylindrical member. The pressuring roller 16 comprises a steel core disposed with a heat-resistant elastomer layer (e.g., silicone sponge or silicone rubber). The elastomer layer of the pressuring roller 16 is pressed against the heating roller 14.

As shown in FIG. 4, the heating roller 14 is rotatably supported at both end portions on support members 20A that are disposed on brackets 20. The pressuring roller 16 is rotatably supported at both end portions on support members 22A that are disposed on pressuring levers 22. The pressuring levers 22 are supported such that they are pivotable about lower pivot points 24 with respect to the brackets 20.

Figure 7:
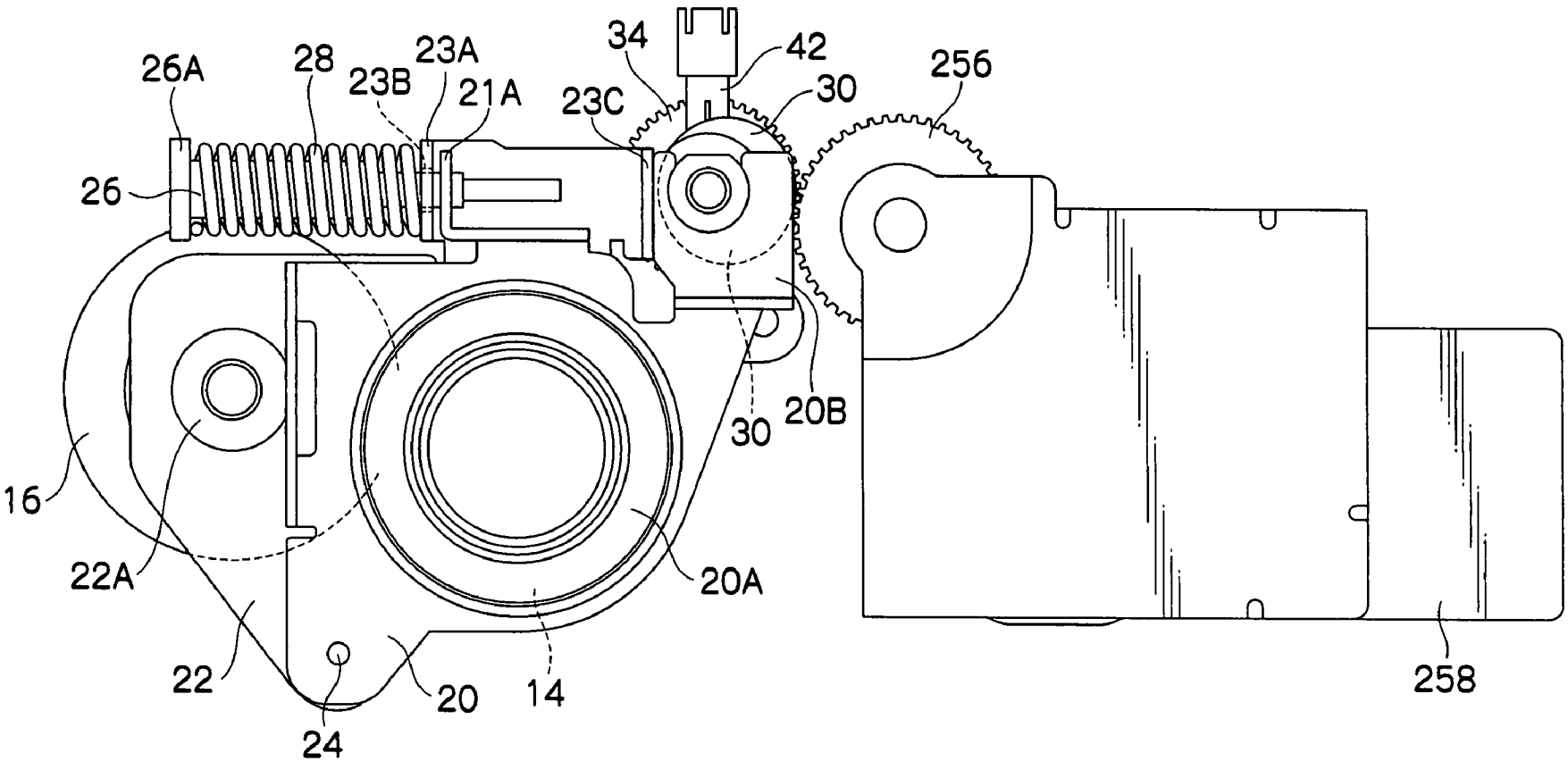
FIG. 7 is a side view showing the attachment structure of the pressuring levers that retain the pressuring roller, the brackets that retain the heating roller, and the cams of the fixing device shown in FIG. 2.

As shown in FIG. 7, guide pieces 21A are disposed above the left and right brackets 20 such that the guide pieces 21A extend substantially parallel to the axis of the heating roller 14, and studs (as a guide portion) 26 are fastened to the guide pieces 21A. Moving pieces 23A are disposed above the pressuring levers 22 at both end portions such that the moving pieces 23A extend substantially parallel to the guide pieces 21A, and the studs 26 are inserted through open holes 23B formed in the moving pieces 23A.

Compression springs 28 are disposed on the peripheries of the studs 26. One end of each of the compression springs 28 contacts flanges 26A of the studs 26, and the other end of each of the compression springs 28 contacts the moving pieces 23A. The compression springs 28 push the moving pieces 23A toward the guide pieces 21A of the brackets 20, whereby the pressuring roller 16 retained in the pressuring levers 22 is pressed by a predetermined load (pressuring force) against the heating roller 14.

Figures 8A, 8B:
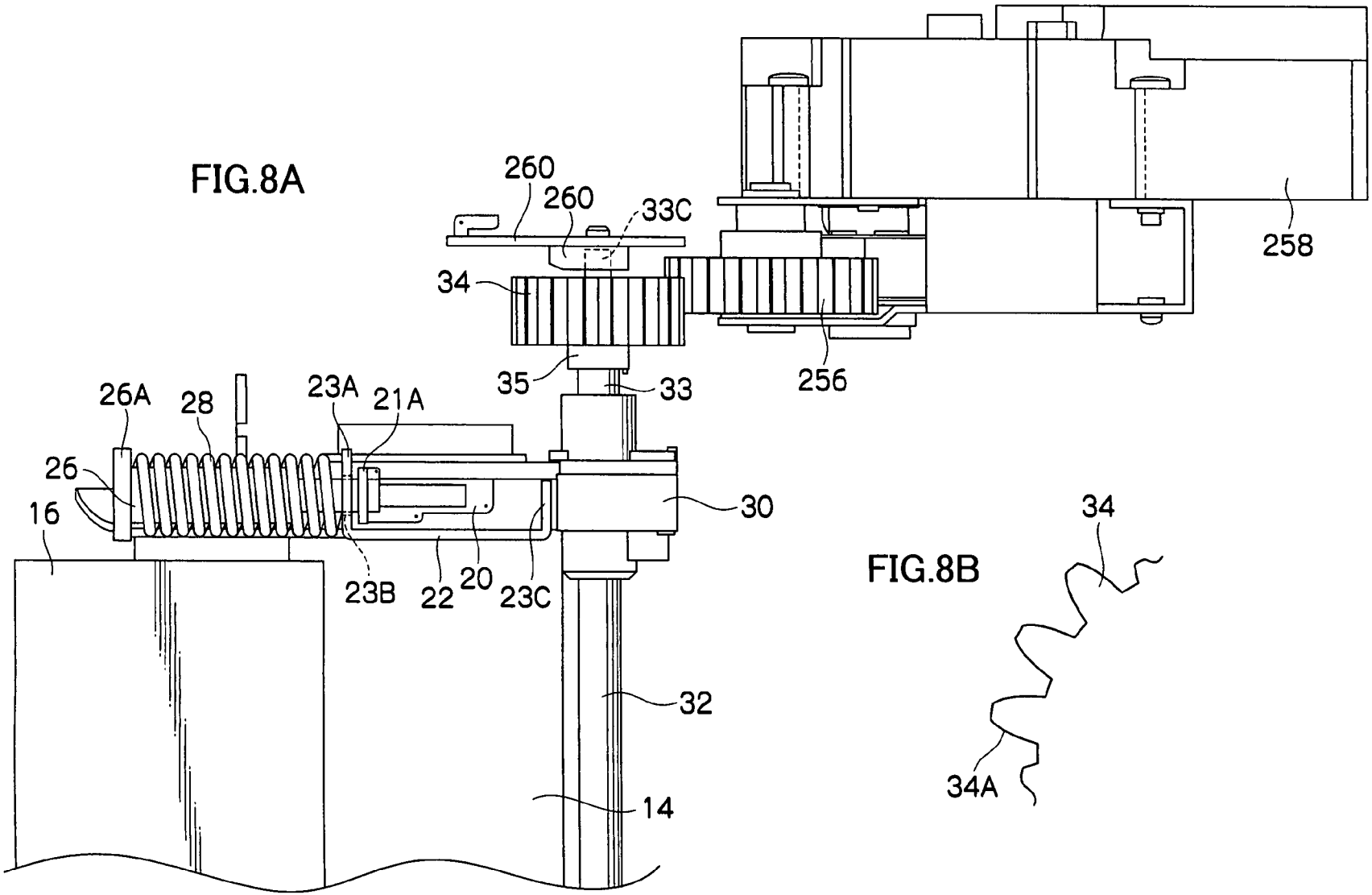
FIG. 8A is a plan view showing the attachment structure of the pressuring levers that retain the pressuring roller, the brackets that retain the heating roller, and the cams of the fixing device shown in FIG. 2.
FIG. 8B is a partially enlarged view of a gear that causes the cams to rotate.

As shown in FIG. 4, contact pieces 23C are disposed substantially parallel to the moving pieces 23A on extension portions 23 of the pressuring levers 22. Cams 30 are rotatably supported on retaining members 20B of the brackets 20 at positions where the cams 30 face the contact pieces 23C, and the cams 30 at both end portions are coupled together by a shaft 32. A gear 34 that transmits driving force to the cams 30 is disposed on an end portion of the shaft 32 connected with one of the cams 30. As shown in FIG. 7 and FIG. 8A, the cams 30 are substantially circular and disposed such that they are offset from the center portion of the shaft 32.

The fixing device 10 includes a first mode that conveys plain paper or the like and a second mode that conveys envelopes or the like, and is configured such that one of the two modes is selected by a control unit (not shown) when the paper is detected by an unillustrated sensor.

In the first mode, the cams 30 do not contact the contact pieces 23C, but in the second mode, the cams 30 rotate to predetermined positions and contact the contact pieces 23C. When the cams 30 contact the contact pieces 23C, the moving pieces 23A compress the compression springs 28, move to a predetermined pressuring position, and cause the pressuring levers 22 to pivot, whereby the pressure of the pressuring levers 22 is adjusted (see FIG. 9). Thus, in the second mode (envelopes or the like), the load (pressuring force) of the pressuring roller 16 on the heating roller 14 becomes smaller in comparison to the load in the first mode (plain paper or the like).

Figure 3:
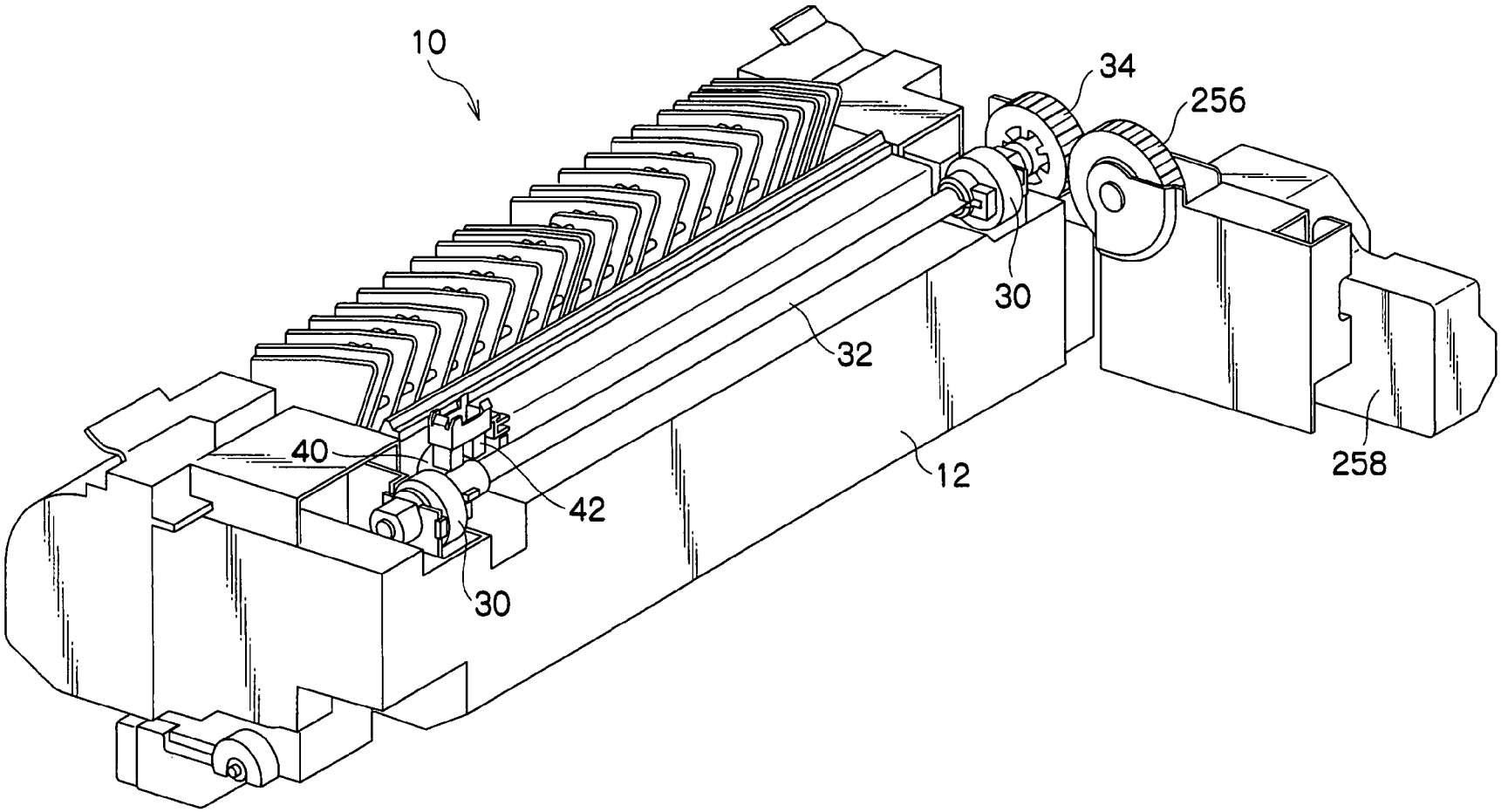
FIG. 3 is a perspective view of the fixing device shown in FIG. 2 seen from the direction of cams.

As shown in FIGS. 2 to 4, a gear 256 that meshes with the gear 34 is disposed in the image forming apparatus body 200, and a drive unit 258 including a motor that transmits driving force to the gear 256 is attached to an unillustrated frame. Thus, the drive unit 258 transmits driving force to the gear 256 to cause the gear 34 to rotate, whereby one of the cams 30 (the cam 30 at the far side in FIG. 3) coupled to the shaft 32 rotates, and the other cam 30 (the cam 30 at the near side in FIG. 3) rotates via the shaft 32.

A drive unit (not shown) for causing the heating roller 14 to rotate is disposed on the support member 20A of the bracket 20 at the side opposite (the near side in FIG. 4) from the drive unit 258 with respect to the shaft 32. Driving force is transmitted from the unillustrated drive unit, whereby the heating roller 14 rotates and the pressuring roller 16 rotates following the rotation of the heating roller 14. Because the drive unit 258 that causes the cams 30 to rotate and the unillustrated drive unit that causes the heating roller 14 to rotate are disposed at opposite sides, they are efficiently disposed inside the image forming apparatus 11, which is advantageous in terms of space.

As shown in FIG. 4, a reading plate 40 including a slit (not shown) for reading the rotational position of the cams 30 is disposed on the shaft 32 opposite from the drive unit 258. A sensor 42 that detects the slit is disposed at a position where the sensor sandwiches and faces the reading plate 40. The sensor plate 42 is attached to the unillustrated frame of the image forming apparatus body 200 and remains in the image forming apparatus body 200 when the fixing device 10 is removed, which makes possible a reduction in cost.

Figure 5:
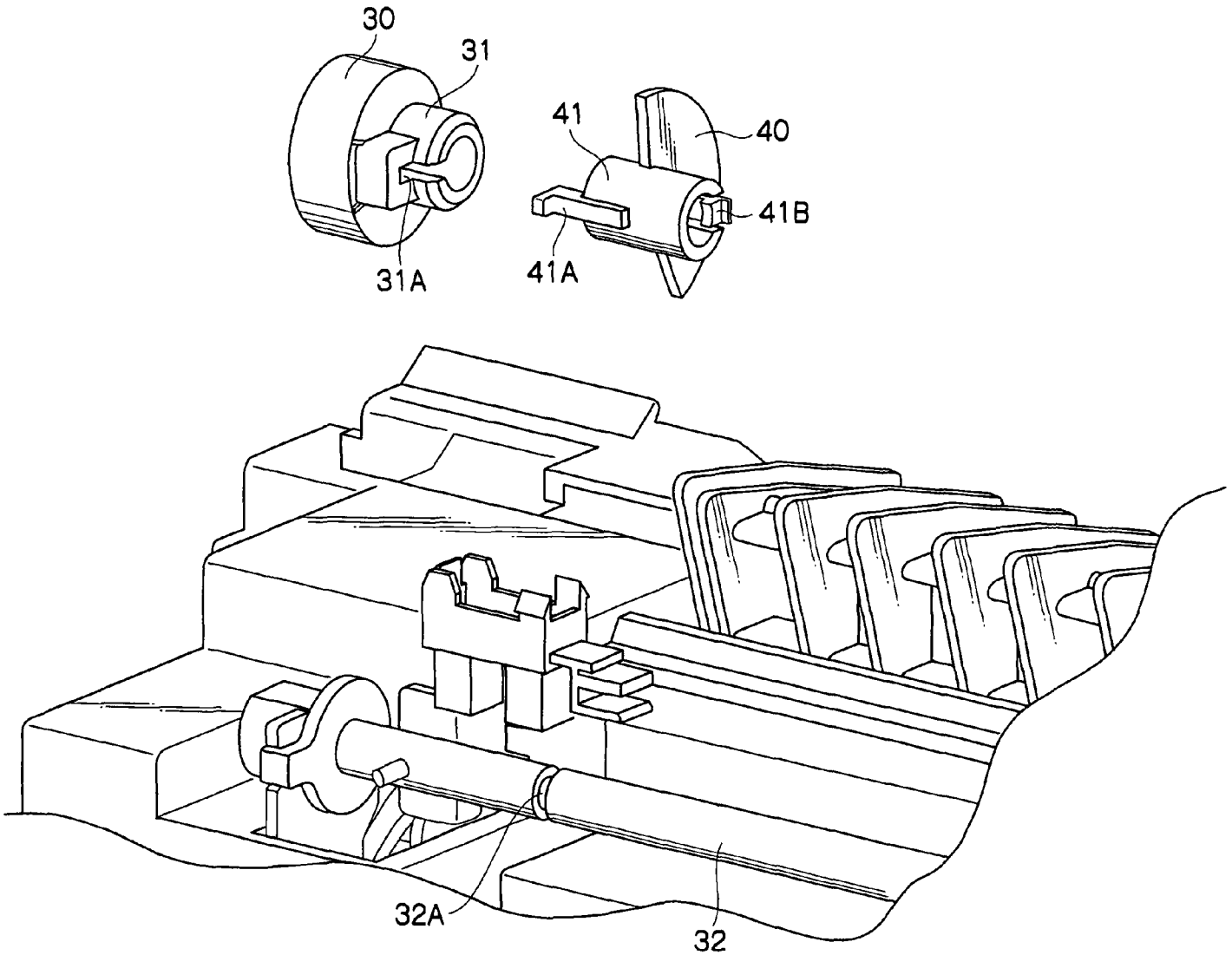
FIG. 5 is an exploded perspective view showing an attachment structure of a cam and a reading plate of the fixing device shown in FIG. 2.

As shown in FIG. 5, an L-shaped protruding portion 41A is disposed on a shaft portion 41 of the reading plate 40 such that the protruding portion 41A protrudes outward from the peripheral surface of the shaft portion 41. The protruding portion 41A is fitted together with a concave fitting portion 31A formed in the direction orthogonal to the rotational direction inside a shaft portion of the cam 30.

An elastically deformable snap-fit portion 41B is disposed such that it protrudes inside the shaft portion 41 of the reading plate 40. The snap-fit portion 41B snap-fits into a groove portion 32A formed in the peripheral surface of the shaft 32, whereby the reading plate 40 is fixed to the shaft 32.

Thus, the precision of the rotational direction of the cam 30 and the reading plate 40 can be raised in comparison to when the cam 30 and the reading plate 40 are directly attached to the shaft 32. Also, as shown in FIG. 4, although there is concern that the shaft 32 will become kinked because there is rotational resistance in the cam 30 (at the near side in FIG. 4) opposite from the cam 30 disposed near the drive unit 258 of the gear 34, the reading precision can be raised by reading, with the reading plate 40, the rotational position of the cam 30 at the kinked side.

Figure 6:
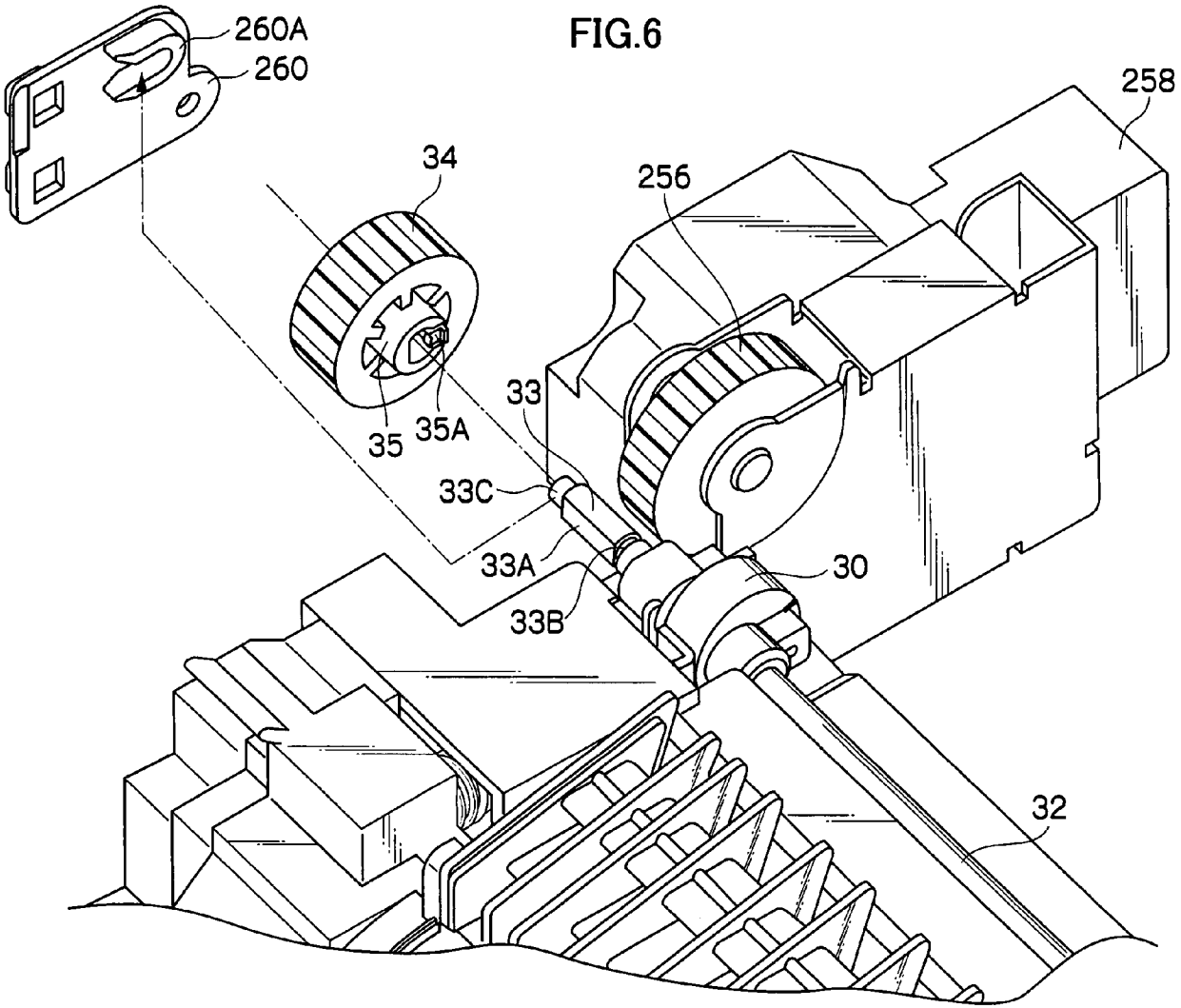
FIG. 6 is an exploded perspective view showing an attachment structure of gears and a shaft of the fixing device shown in FIG. 2.

As shown in FIG. 6, a D-cut surface 33A is formed on a shaft end portion 33 that the shaft 32 penetrates, and the shaft end portion 33 is inserted through a shaft portion 35, on which a D-cut surface is formed, of the gear 34. An elastically deformable snap-fit portion 35A is disposed inside the shaft portion 35. The snap-fit portion 35A is snap-fitted into a groove portion 33B in the shaft end portion 33, whereby the gear 34 is fixed. Because the gear 34 is fixed to the shaft end portion 33 by the snap-fit portion 35A, it is not necessary to screw the gear 34 onto the shaft end portion 33, and the assembly becomes easy.

A circular end portion 33C is formed on the terminal end portion of the D-cut surface 33A of the shaft end portion 33. The circular end portion 33C protrudes when the gear 34 is fixed to the shaft end portion 33. The circular end portion 33C is configured to be insertable into a lateral U-shaped shaft bearing 260A formed in a shaft bearing member 260. The shaft bearing member 260 is attached to the unillustrated frame of the image forming apparatus 200. The shaft bearing member 260 fixes and/or positions the fixing device 10 with respect to the image forming apparatus body 200 as a result of the circular end portion 33C being inserted into the shaft bearing 260A.

By disposing the shaft bearing 260A of the gear 34 in the image forming apparatus body 200 and retaining the circular end portion 33C at the outer side of the gear 34, the gear 34 can be firmly fixed. Thus, even if the torque of the cams 30 is large, the shaft 32 and the fixing device 10 themselves do not end up moving due to the rotation of the gear 34.

Also, because the gear 34 is directly attached to the shaft end portion 33 of the shaft 32 and the circular end portion 33C is guided by the shaft bearing 260A, its position and drive transmission precision can be improved. Consequently, because it becomes difficult for the fixing device 10 to move when the fixing device 10 has been attached to the image forming apparatus body 200, the positional precision of the reading plate 40 becomes higher, and precise detection becomes possible even when the sensor 42 is disposed in the image forming apparatus body 200. A reduction in cost is also made possible in comparison to when the sensor 42 is disposed in the fixing device 10.

As shown in FIG. 8B, the gear 34 includes teeth 34A that are high. For this reason, when the fixing device 10 is to be attached to the image forming apparatus body 200, it is difficult for the tooth tips of the gear 34 and the gear 256 of the image forming apparatus body 200 to knock against each other, and the fixing device 10 can be smoothly attached to the image forming apparatus body 200. When the gear 34 has usual teeth, the tooth tips of the gear 34 and the gear 256 of the image forming apparatus body 200 knock against each other, and the fixing device 10 cannot be smoothly attached.

This problem can be solved by tapering the tooth tips of the gear 34, which can be accomplished in two ways: with high teeth or with a displacement gear. In the case of a displacement gear, the drive tangent becomes oblique, the fixing device 10 easily moves, and there is skipping. If the teeth 34A of the gear 34 are high teeth, the drive tangent becomes perpendicular and there is no skipping.

Next, the action of the fixing device 10 will be described.

As shown in FIG. 7, in the first mode (plain paper or the like), the cams 30 rotate in positions (home positions) where they do not contact the contact pieces 23C of the pressuring levers 22. Thus, the moving pieces 23A of the pressuring levers 22 move toward the guide pieces 21A of the brackets 20 due to the pressuring force of the compression springs 28. For this reason, the pressuring roller 16 retained in the pressuring levers 22 is pressed by a predetermined load against the heating roller 14 retained in the brackets 20.

In the first mode, the pressuring roller 16 has a fixed load, and the elastomer layer of the pressuring roller 16 is elastically deformed as a result of the pressuring roller 16 being pressed against the heating roller 14 by a high load. Thus, the plain paper or the like is conveyed between the heating roller 14 and the pressuring roller 16, and the toner image can be fixed onto the plain paper.

Figure 9:
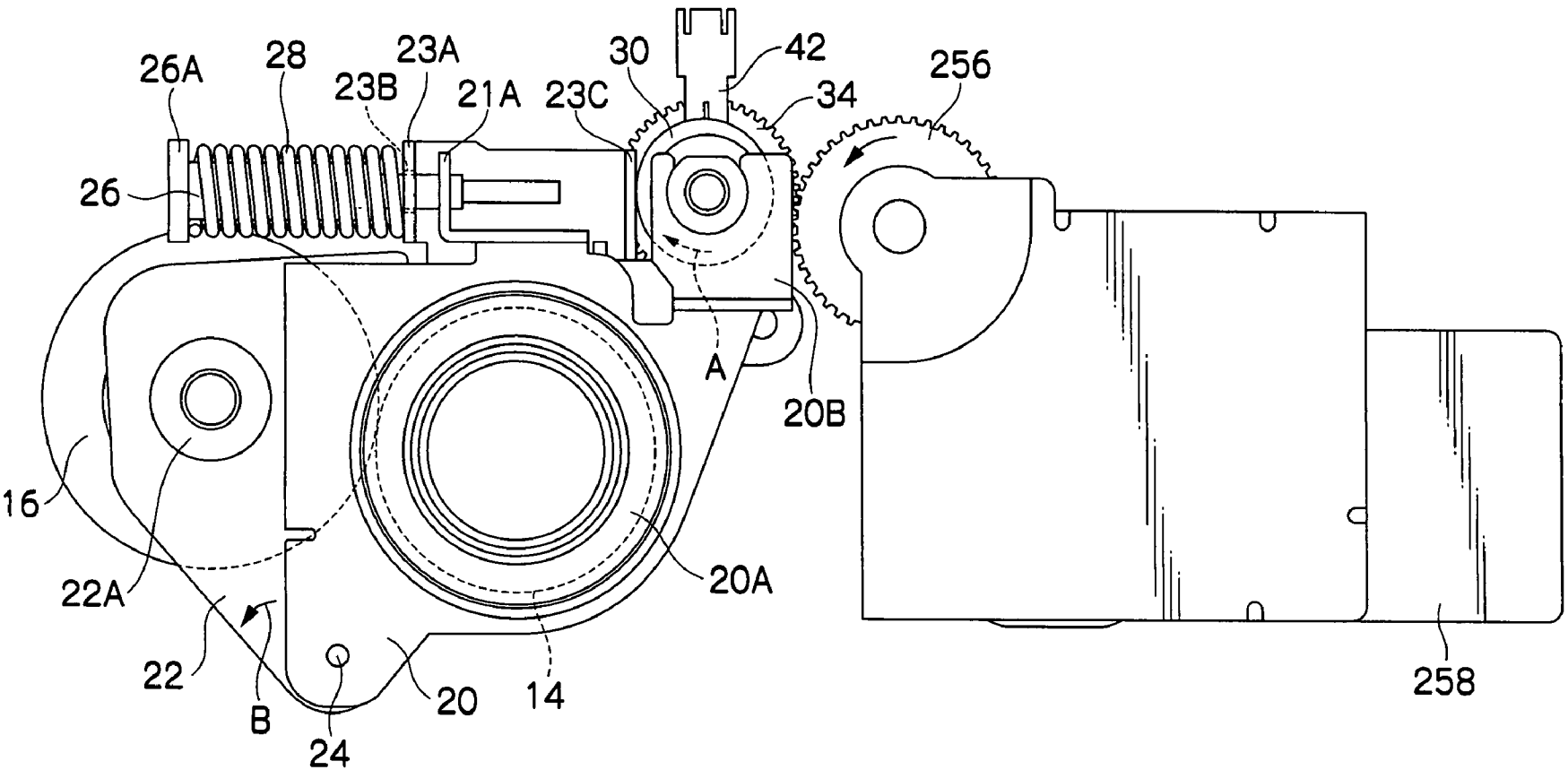
FIG. 9 is a side view showing a state where the cams of the fixing device shown in FIG. 2 have rotated and where the pressuring levers have pivoted.

As shown in FIG. 9, in the second mode (envelopes or the like), the gear 34 meshing with the gear 256 is caused to rotate as a result of the drive unit 258 causing the gear 256 to rotate in the direction of the arrow. Thus, the cam 30 coupled by the shaft 32 to the gear 34 rotates in the direction of arrow A. Then, the cams 30 rotate and contact the contact pieces 23C, and the moving pieces 23A compress the compression springs 28 and move to the predetermined pressuring position because the studs 26 are inserted into the open holes 23B of the moving pieces 23A. Thus, the pressuring levers 22 pivot to the predetermined pressuring position in the direction of arrow B around the pivot points 24, and the pressuring roller 16 retained in the pressuring levers 22 moves in the direction where the interaxial distance between the pressuring roller 16 and the heating roller 14 increases. At this time, the pressuring roller 16 becomes fixedly displaced (interaxially fixed).

Thus, in the second mode (envelopes or the like), the load of the pressuring roller 16 on the heating roller 14 becomes smaller in comparison to the load in the first mode.

In the fixing device 10, the load of the pressuring roller 16 on the heating roller 14 can be appropriately adjusted depending on the type of paper (such as plain paper or envelopes), and the occurrence of wrinkles in the paper can be suppressed. Also, because the power relationship between the brackets 20, the pressuring levers 22, the compression springs 28 and the cams 30 is closed just among four parts, this is advantageous in terms of the deformation and precision of the constituent parts. It is also easy to assemble the constituent parts. And because the stroke of the pressuring levers 22 is small, this is advantageous in terms of the design of the cams 30.

Also, as shown in FIG. 9, the rotational direction of the cams 30 (direction of arrow A) is set in a forward direction that does not disturb the pivoting of the pressuring levers 22 (direction of arrow B). If the rotational direction of the cams 30 is set in a direction that disturbs the pivoting of the pressuring levers 22, the movement of the pressuring levers 22 becomes jerky and the pressuring levers 22 do not move smoothly. But by making the rotational direction of the cams 30 the forward direction that does not block the pivoting of the pressuring levers 22, the movement of the pressuring levers 22 can be made smooth.

Figure 10:
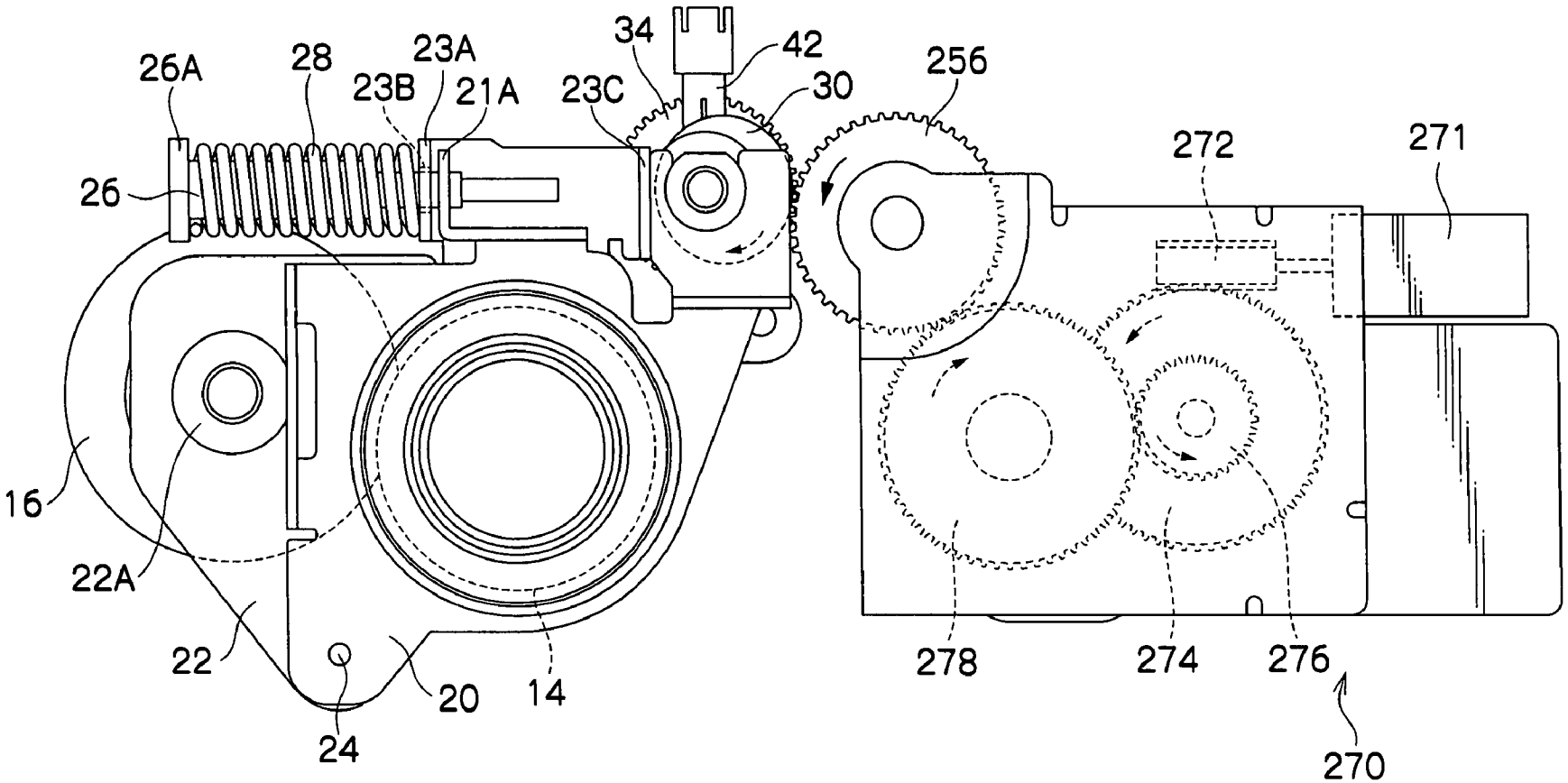
FIG. 10 is a configural view showing an example of a drive mechanism of the cams of the fixing device shown in FIG. 2.

FIG. 10 shows an example of a drive unit 270 that transfers driving force to the gear 256. The drive unit 270 includes a motor 271 and a worm 272 that is coupled to the motor 271. A worm gear 274 meshes with the worm 272, and a transmission gear 276 is disposed coaxially with the worm gear 274.

A transmission gear 278 meshes with the transmission gear 276, and the gear 256 meshes with the transmission gear 278. The motor 271 is a DC motor, causes the worm gear 274 to rotate in the direction of the arrow due to the worm 272, and causes the transmission gears 276 and 278 and the gear 256 to rotate in the directions of the arrows.

By disposing the worm 272 and the worm gear 274, the high-revolution motor 271 can be slowed down and the driving force can be transmitted. If the cams 30 are required to rotate at an extremely low rotation and a high load, the combination of the DC motor, the worm 272 and the worm gear 274 is advantageous in terms of space, cost, and output.

Also, because the motor 271 only revolves for an extremely limited amount of time when the motor 271 causes the cams 30 to rotate, an inexpensive brush motor can be used.

In the fixing device 10, bearings (not shown) may be disposed on the contact surfaces of the cams 30. By disposing bearings, the sliding resistance between the cams 30 and the contact pieces 23C can be lowered.

Second Embodiment

Next, a fixing device of a second embodiment of the invention will be described.

The same reference numerals will be given to members that are the same as those in the first embodiment, and redundant description of those same members will be omitted.

Figure 11:
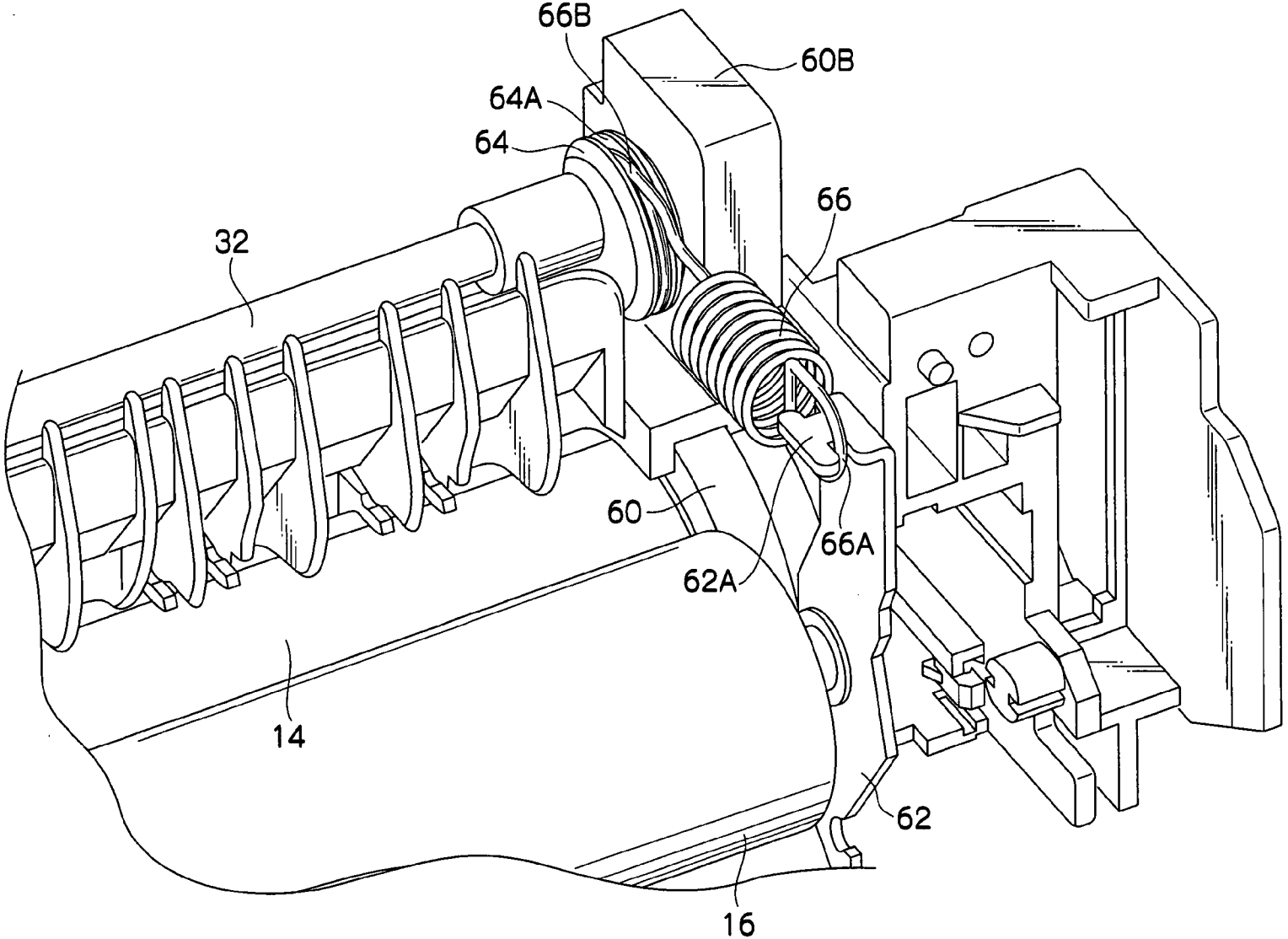
FIG. 11 is a partial perspective view showing the relevant portions of a fixing device pertaining to a second embodiment of the invention.

As shown in FIG. 11, the fixing device includes pressuring levers 62 that retain the pressuring roller 16 and are pivotably supported on brackets 60 that retain the heating roller 14. End portions 66A of tension springs 66 are attached to guide members 62A of the pressuring levers 62. Groove portions 64A are formed in the peripheral surfaces of cams 64 disposed on retaining members 60B of the brackets 60, and hooks 66B formed on the other end portions of the tension springs 66 are hooked in the groove portions 64A. The pressuring levers 62 are pulled toward the brackets 60 by the tension springs 66, whereby the pressuring roller 16 is pushed against the heating roller 14.

The load of the pressurizing roller 16 is adjusted because the rotational axes of the cams 64 are eccentric, the pressuring levers 62 pivot due to the rotation of the cams 64, and the interaxial distance between the heating roller 14 and the pressuring roller 16 is variable. Thus, the configuration can be simplified in a fixing device of the type where the interaxial distance is variable. Also, because the hooks 66B of the tension springs 66 are hooked in the groove portions 64A, the hooks 66B can be firmly retained.

Third Embodiment

Next, a fixing device of a third embodiment of the invention will be described.

The same reference numerals will be given to members that are the same as those in the first and second embodiments, and redundant description of those same members will be omitted.

Figure 12:
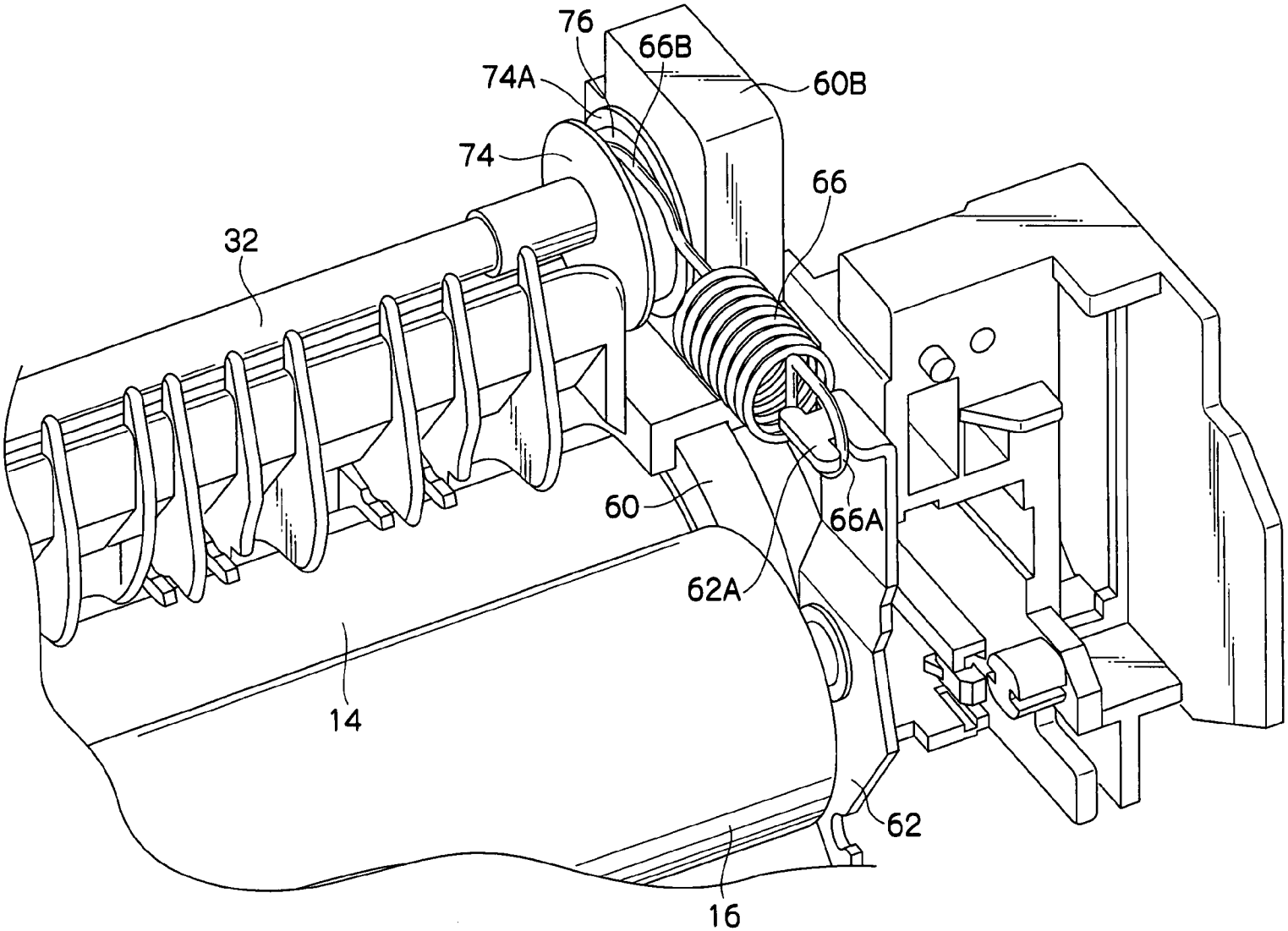
FIG. 12 is a partial perspective view showing the relevant portions of a fixing device pertaining to a third embodiment of the invention.
Figure 13B:
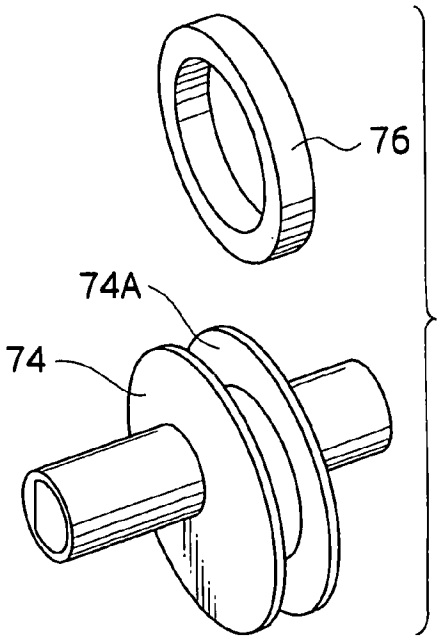
FIGS. 13A and 13B are a partial perspective view and an exploded perspective view showing the relevant portions of the fixing device pertaining to the third embodiment of the invention.
Figure 13A:
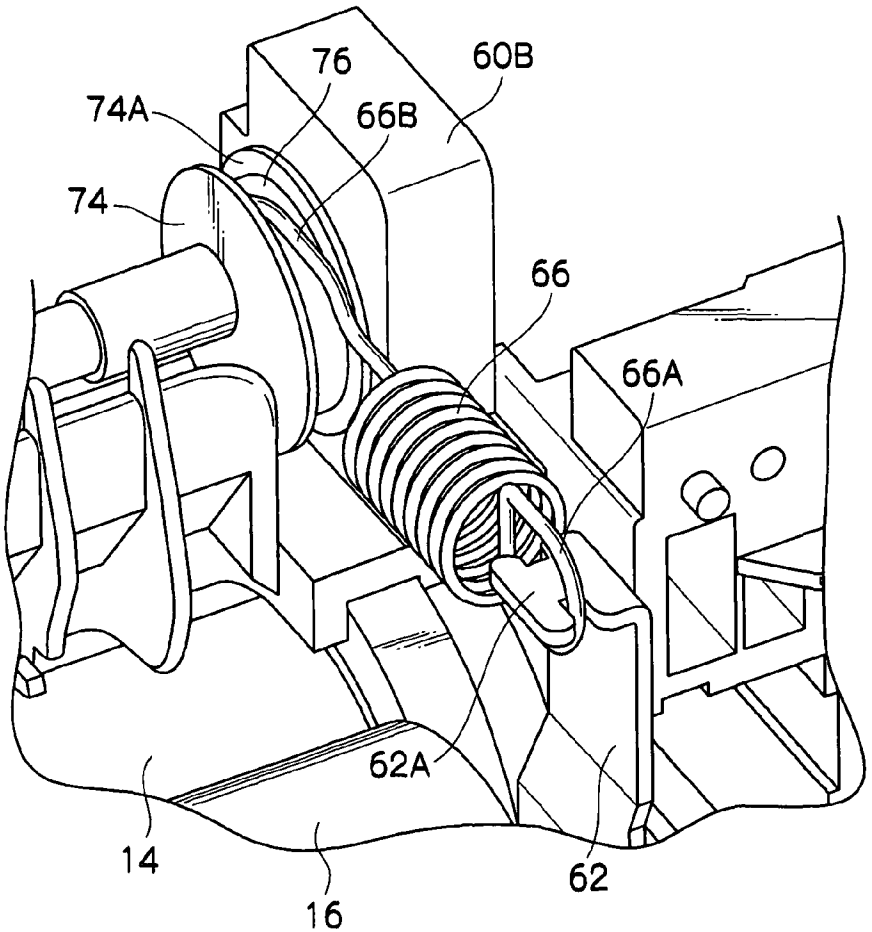

As shown in FIG. 12 and FIGS. 13A and 13B, in this fixing device, groove portions 74A are formed in the outer peripheries of cams 74 supported in retaining members 60B, and bearings 76 are disposed in the groove portions 74A. The hooks 66B of the tension springs 66 are hooked onto the bearings 76.

In this fixing device, because the hooks 66B of the tension springs 66 are hooked onto the bearings 76, the sliding resistance between the cams 74 and the hooks 66B becomes smaller when the cams 74 rotate.

Fourth Embodiment

Next, a fixing device of a fourth embodiment of the invention will be described.

The same reference numerals will be given to members that are the same as those in the first embodiment, and redundant description of those same members will be omitted.

Figure 14:
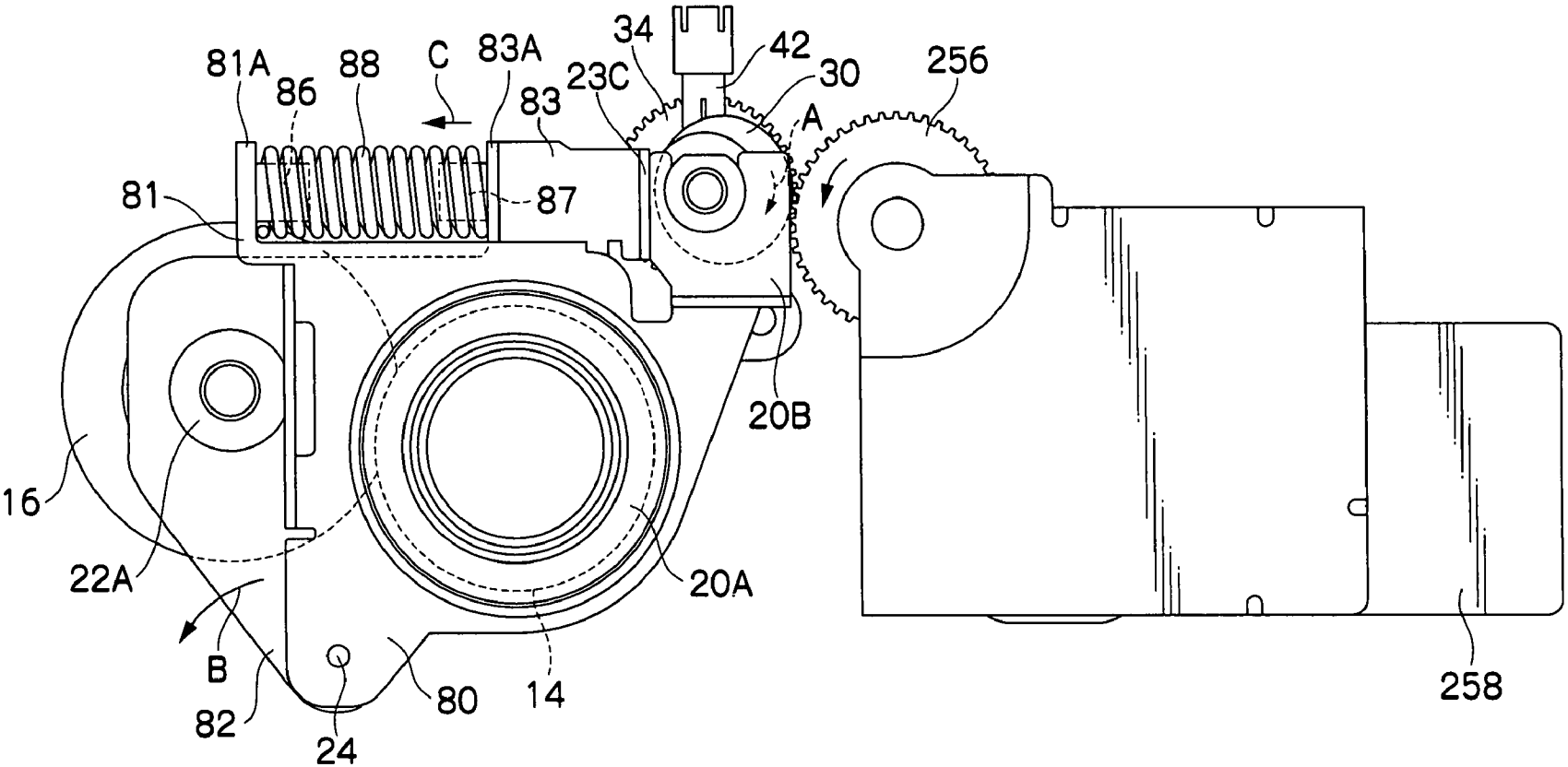
FIG. 14 is a side view showing an attachment structure of pressuring levers, brackets, and compression springs of a fixing device pertaining to a fourth embodiment of the invention.

As shown in FIG. 14, in this fixing device, leading end portions 81 of brackets 80 that retain the heating roller 14 and leading end portions 83 of pressuring levers 82 that retain the pressuring roller 16 cross at the pivoting end portion side of the pressuring levers 82.

Spring receiving portions 81A are formed on the leading end portions 81 substantially parallel to the axial direction of the heating roller 14, and spring receiving portions 83A are disposed on the leading end portions 83 a predetermined distance away from the spring receiving portions 81A. Bosses 86 are attached to the spring receiving portions 81A, and bosses 87 are attached to the spring receiving portions 83A. Both end portions of compression springs 88 are retained on these bosses 86 and 87. Contact pieces 23C that can be contacted by the cams 30 are formed on the leading end portions 83.

In this fixing device, when the cams 30 rotate in the direction of arrow A and contact the contact pieces 23C, the compression springs 88 are compressed and the spring receiving portions 83A move in the direction of arrow C. Thus, the pressuring levers 82 pivot in the direction of arrow B, and the load of the pressuring rollers 16 retained in the pressuring levers 82 is adjusted.

In this fixing device, because the compression springs 88 are disposed between the spring receiving portions 81A of the brackets 80 and the spring receiving portions 83A of the pressuring levers 80, the studs 26 shown in FIG. 7 can be omitted and the number of parts can be reduced.

What is claimed is:

1. A fixing device for an image forming apparatus, the device comprising:

a heating member disposed with an internal heating source and a pressuring member that presses against the heating member;

brackets that retain the heating member;

pressuring levers that retain the pressuring member and are movably supported in the brackets;

urging means that push the pressuring levers in a direction where the pressuring member presses against the heating member; and tension adjusting means that are rotatably supported in the brackets, contact the pressuring levers, and adjust the pressuring force of the pressuring member, wherein the fixing device is attachable to and detachable from the image forming apparatus body;

wherein a first gear rotates the tension adjusting means, and the gear meshes with a second gear disposed in the image forming apparatus when the fixing device is attached to the image forming apparatus, wherein the fixing device includes a first mode where the tension adjusting means do not contact the pressuring levers and a second mode where the tension adjusting means contact the pressuring levers and the pressuring levers move to a predetermined pressuring position, wherein in the first mode the pressuring member has a fixed load, and wherein in the second mode, the pressuring levers are fixedly displaced, wherein the first gear that rotates the tension adjusting means is fixed to a D-cut surface of a shaft, and an end portion of the shaft penetrating the first gear is supported in a bearing of the shaft.

2. The fixing device of claim 1, wherein the pressuring levers and the tension adjusting means are disposed at both end portions of the pressuring member, wherein the shaft transmits the rotation of one of the tension adjusting means to the other of the tension adjusting means, and the fixing device further includes a reading plate that is disposed on an end portion of the shaft and is for reading the rotational position of the tension adjusting means, and the reading plate is disposed near the other of the tension adjusting means.

3. The fixing device of claim 2, wherein the reading plate is attached to the other of the tension adjusting means.

4. The fixing device of claim 2, wherein the first gear that transmits driving force to the shaft is disposed on the shaft, and the bearing of the shaft is disposed in the image forming apparatus body.

5. The fixing device of claim 4, wherein the first gear includes teeth that are high teeth.

6. The fixing device of claim 4, wherein a snap-fit portion disposed in the first gear is snap-fitted into a groove formed in the shaft.

7. The fixing device of claim 4, wherein the bearing of the shaft fixes or positions the fixing device with respect to the image forming apparatus body.

8. The fixing device of claim 7, wherein the first gear that transmits driving force to the shaft is disposed opposite from a drive mechanism that drives the heating member or the pressuring member.

9. The fixing device of claim 2, wherein a sensor that detects a slit in the reading plate is disposed in the image forming apparatus body.

10. The fixing device of claim 1, wherein the rotational direction of the tension adjusting means is set in a forward direction that does not disturb the pivoting of the pressuring levers.

11. The fixing device of claim 1, further comprising a motor that drives the tension adjusting means, is a DC motor, is slowed down by a worm gear and transmits driving force.

12. The fixing device of claim 11, wherein the motor is a brush motor.

13. The fixing device of claim 1, wherein the urging means are configured by guide members disposed such that they extend from the brackets, open holes that are formed in the pressuring levers and through which the guide members are inserted, and compression springs through which the guide members are inserted, with the compression springs including one end that contacts edge portions of the open holes and another end that contacts flanges formed on end portions of the guide members.

14. The fixing device of claim 1, wherein the urging means are configured by first spring receivers formed in the brackets, second spring receivers that are formed in the pressuring levers and are positioned nearer to the tension adjusting means than the first spring receivers, and spring receiver-use compression springs that are disposed between the first spring receivers and the second spring receivers.

15. An image forming apparatus including the fixing device of claim 1.

16. The fixing device of claim 1, wherein the tension adjusting means are cams.

17. The fixing device of claim 1, wherein the urging means are compression springs.

18. The fixing device of claim 1, wherein the tension adjusting means adjust the pressuring force of the pressing member from a high pressure to a low pressure.

19. A fixing device for an image forming apparatus, the device comprising:

a heating member disposed with an internal heating source and a pressuring member that presses against the heating member;

brackets that retain the heating member;

pressuring levers that retain the pressuring member and are movably supported in the brackets;

compression springs that push the pressuring levers in a direction where the pressuring member presses against the heating member; and cams that are rotatably supported in the brackets, contact the pressuring levers, and adjust the pressuring force of the pressuring member, wherein the fixing device is attachable to and detachable from the image forming apparatus body;

wherein a first gear rotates the cams, and the first gear meshes with a second gear disposed in the image forming apparatus when the fixing device is attached to the image forming apparatus, wherein the fixing device includes a first mode where the cams do not contact the pressuring levers and a second mode where the cams adjusting means contact the pressuring levers and the pressuring levers move to a predetermined pressuring position, wherein in the first mode the pressuring member has a fixed load, and wherein in the second mode, the pressuring levers are fixedly displaced, wherein the first gear that rotates the cams is fixed to a D-cut surface of a shaft, and an end portion of the shaft penetrating the first gear is supported in a bearing of the shaft.

20. The fixing device of claim 19, wherein the cams adjust the pressuring force of the pressing member from a high pressure to a low pressure.

* * * * *